US007654053B1

(12) United States Patent
Bauer

(10) Patent No.: US 7,654,053 B1
(45) Date of Patent: Feb. 2, 2010

(54) CONCRETE VAPOR BARRIER INTEGRITY SYSTEM

(76) Inventor: Michael Bauer, 615 McGlincy La., Campbell, CA (US) 95008

( * ) Notice: Subject to any disclaimer, the term of this patent is extended or adjusted under 35 U.S.C. 154(b) by 677 days.

(21) Appl. No.: 10/907,474

(22) Filed: Apr. 1, 2005

(51) Int. Cl.
*E04G 23/00* (2006.01)

(52) U.S. Cl. ..... 52/514; 52/367; 52/698

(58) Field of Classification Search ..... 52/220.8, 52/366, 367, 408, 414, 368, 369, 361–363, 52/698–700, 370, 372–377; 411/480, 531, 411/542

See application file for complete search history.

(56) References Cited

U.S. PATENT DOCUMENTS

| | | | | |
|---|---|---|---|---|
| 2,436,291 | A * | 2/1948 | Daniel | 15/257.05 |
| 4,361,993 | A | 12/1982 | Simpson | |
| 4,472,920 | A | 9/1984 | Simpson | |
| 4,635,895 | A | 1/1987 | Johnson, Jr. et al. | |
| 4,653,241 | A | 3/1987 | Bindi | |
| 4,711,058 | A | 12/1987 | Patton | |
| 4,875,805 | A | 10/1989 | Gross | |
| 4,916,939 | A | 4/1990 | Mogel | |
| 5,922,421 | A | 7/1999 | Perry | |
| 6,035,595 | A * | 3/2000 | Anderson | 52/363 |
| 6,673,412 | B2 | 1/2004 | Ramesh et al. | |
| 6,708,979 | B2 | 3/2004 | Stratman et al. | |
| 2001/0001683 | A1 * | 5/2001 | Mathieson | 428/57 |
| 2003/0061722 | A1 * | 4/2003 | Bradley | 33/563 |
| 2003/0094771 | A1 | 5/2003 | Stratman et al. | |
| 2004/0031223 | A1 | 2/2004 | Durning et al. | |
| 2004/0136790 | A1 | 7/2004 | Janesky | |
| 2004/0226237 | A1 | 11/2004 | Locke et al. | |
| 2004/0245255 | A1 | 12/2004 | Copley et al. | |
| 2005/0011133 | A1 | 1/2005 | Meyer | |

* cited by examiner

*Primary Examiner*—Richard E Chilcot, Jr.
*Assistant Examiner*—William V Gilbert
(74) *Attorney, Agent, or Firm*—Molly L. Sauter; Smith & Hopen, P.A.

(57) ABSTRACT

The present invention provides a device and method to maintain the integrity of a vapor barrier for use with concrete slab on grade construction. In accordance with the present invention an apparatus to repair a punctured concrete slab vapor barrier includes a substantially planar concrete slab vapor barrier patch having a resealable aperture to receive a removable, substantially upright support. The patch is secured to the existing vapor barrier and the concrete is poured and substantially set. The support is removed and the malleable concrete flows, causing the engagement of the resealable aperture, thereby repairing the punctured vapor barrier.

13 Claims, 9 Drawing Sheets

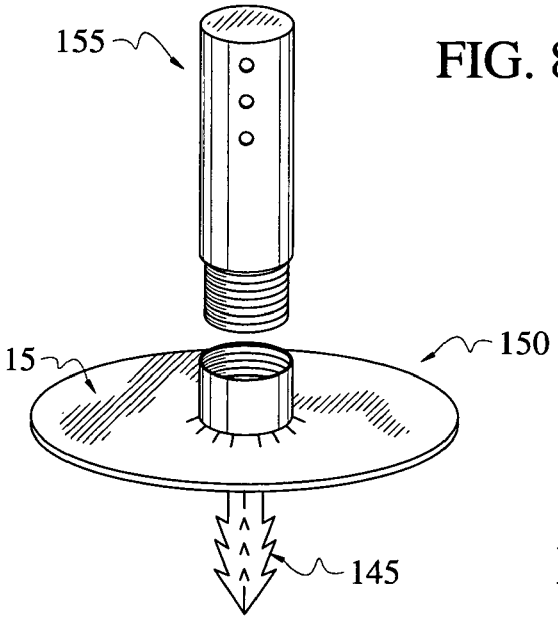
FIG. 8A
FIG. 8B
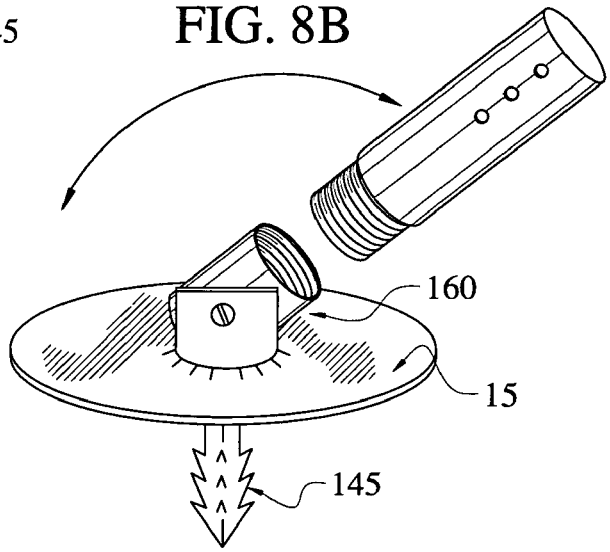
FIG. 8C
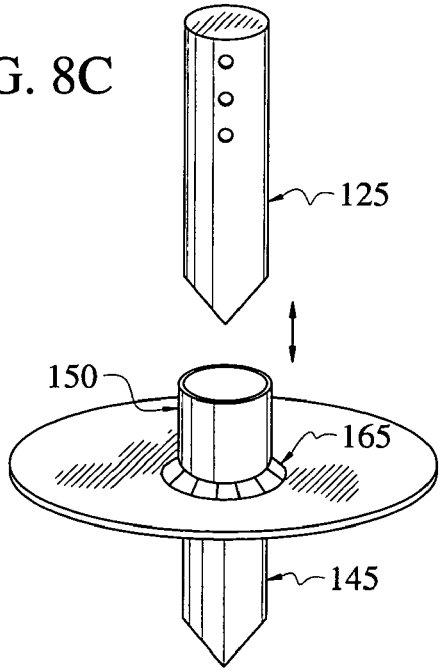

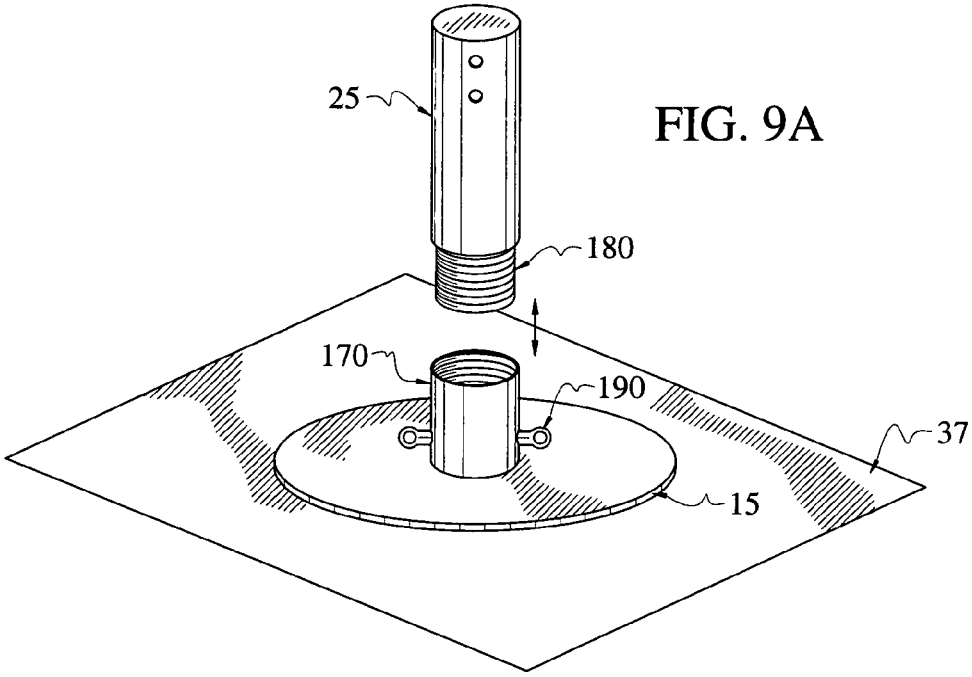
FIG. 9A
FIG. 9B
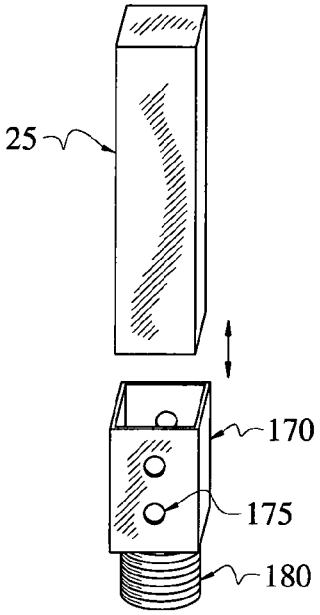
FIG. 9C
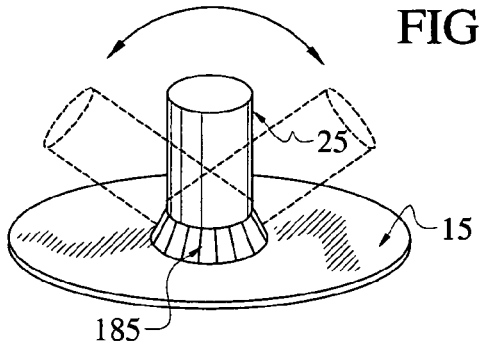
FIG. 9D
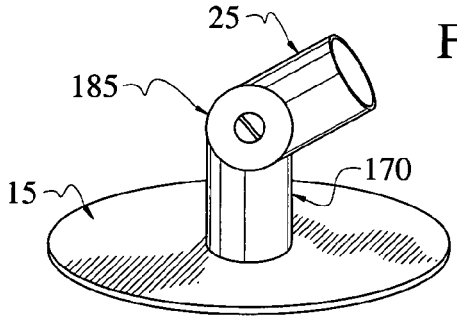

CONCRETE VAPOR BARRIER INTEGRITY SYSTEM

BACKGROUND OF INVENTION

Within the construction industry, slab on grade construction is the most common form of concrete construction for structural buildings. As the name suggests, a slab is a single layer of concrete, several inches in thickness. The slab is typically poured thicker at the edges to form an integral footing with reinforcing rods used to further strengthen the thickened edge. The slab may rest on a bed of crushed gravel to improve drainage. Slab on grade is commonly used in residential, commercial and industrial building construction applications.

When using slab on grade construction, there is often a need to set interior form boards within the monolithic concrete slab. Interior forms are needed to establish varying elevations within the slab, such as between a garage and the living space of a house in a monolithic slab design. Interior form boards are additionally used to establish slab depressions for shower pans or to accommodate localized interior floor covering materials such as stone, tile or pavers. Interior form board are also used to provide a control line as a means to hang anchor bolts and seismic hold-down bolts at interior load bearing and shear walls.

When form boards are utilized in the construction process, the boards are rigidly fixed in place prior to pouring the concrete slab. Accordingly, the form boards must be securely fixed in position so that the weight and the pressure of the concrete, when poured, will not displace them. Close tolerances are required for this process and only a very small margin of error is acceptable. As such, the most common method of fixing interior form boards in place is by driving wood or steel stakes securely into the subgrade and then securing the form boards to the stakes in the desired configuration. Commonly, two types of stakes are utilized to secure the form boards in place. First, vertical stakes are installed to hold the form boards in line and to elevation. Second, brace stakes are driven into the ground at approximately a forty-five degree angle and nailed to the vertical stake or form boards to hold it in line against the lateral pressures of the concrete. The stakes are then removed after the concrete is poured and just after it has reached its initial set, at a point where the forms boards will hold their shape without being displaced by the weight or pressure of the surrounding concrete, but while the concrete has a viscosity that will allow it to consolidate into voids.

Inherent to the concrete slab on grade construction process is the problem of moisture migration through the slab from the underlying soil. Adverse impacts of excess moisture in the slab include adhesion loss, warping, peeling, unacceptable appearance of resilient flooring, deterioration of adhesives, ripping or separation of seams, air bubbles or efflorescence beneath seamed continuous flooring, damage to flat electrical cable systems, buckling of carpet and carpet tiles, offensive odors, and growth of fungi. Moisture migration through soils and concrete slabs on grade not only creates a problem for the performance of floor covering and coating systems, but can also contribute to indoor air quality issues. Moisture beneath floor coverings or within adhesives or carpets can provide an environment suitable to further microbial development, adversely affecting indoor air quality.

To reduce the amount of moisture available within or beneath a flooring system an effective vapor barrier or vapor retarder is typically installed beneath the concrete slab. Vapor barriers are often placed on the subgrade beneath the concrete slab to minimize vapor transmission through the concrete slab. The vapor barrier serves to block or slow down the transfer of moisture from the ground into the concrete slab, thereby reducing the devastating effects on floor coverings that promote mold and fungi growth. Vapor barriers are typically sheeting materials based on polyethylene or polyolefin technology. In slab on grade construction, the vapor barrier or retarder is placed on top of the subgrade. As directed by the ASTM (American Society for Testing and Materials) Designation: E 1643-98 Standard Practice for Installation of Water Vapor Retarders used in Contact with Earth or Granular Fill Under Concrete Slabs, it is desirable that the vapor retarder be positioned to lap over footings or seal to the foundation wall, or both, and seal around penetrations such as utilities and columns in order to create a monolithic membrane between the surface of the slab and moisture sources below the slab and at the slab perimeter. The ASTM also provides guidelines for the protection of the vapor barrier against damage during installation of reinforcing steel and utilities and during placement of concrete. In accordance with the ASTM guidelines a damaged vapor retarder should be repaired with vapor barrier material or as instructed by the manufacturer by lapping beyond the damaged area a minimum of 6 inches and sealing as prescribed for sheet joints. Damage to the vapor barrier that is not repaired, increases the moisture exposure of the concrete slab, thereby increasing the risk of problems associated with excessive moisture in the slab.

In the slab on grade construction process, vapor barriers are installed over the subgrade and before any interior form boards are placed. Accordingly, when the wood or steel stakes used to support the form boards are driven into the subgrade, the vapor barrier is invariably punctured. Since these stakes are not removed until after the concrete is poured and sufficiently set, it is not possible to repair the stake hole punctures in the vapor barrier. In addition, concrete contractors using hand screed equipment to place and level concrete customarily use screed pins which are merely round steel stakes driven vertically through the vapor barrier into the subgrade in order to support the screed bar. The screed pins penetrate the vapor barrier and leave holes when removed.

Because punctures in the vapor retarder can significantly increase water-vapor emissions through concrete floor slabs, efforts have been made to minimize the damage to the vapor barrier. It is known in the art to apply a layer of sand or a granular layer over the vapor barrier to reduce the possibility of damage due to machinery and foot traffic. In is also known in the art to specify a thick vapor retarder that will be more puncture-resistant during typical construction activities. The ASTM indicates that the use of stakes driven through the vapor retarder should be avoided because they puncture the vapor barrier, leaving a hole which cannot be repaired after removal of the stakes because the resulting hole is under the surface of the concrete slab. In an effort to satisfy this requirement, solutions have been provided that allow for the placement of support structures for form boards that do not puncture the retarder, such as a pad-and-post support for slab edge forms. However, these support structures are inadequate to be used to support interior forms boards because they are not securely fixed in place. They are unstable and unable to support the weight and pressures of the concrete and therefore the form boards to not hold their shape as required. The prior art does not describe a means for maintaining the integrity of a vapor barrier utilized during the construction process of the slab on grade foundation.

Accordingly, what is needed in the art is an apparatus and method to maintain the integrity of the vapor barrier when utilizing form board support stakes or screed pins, which are removed after the concrete slab has been poured. Additionally, a need exists in the art for an apparatus and method to secure support structures used in slab on grade construction that are capable of withstanding the pressure and weight of poured concrete.

SUMMARY OF INVENTION

In accordance with the present invention is provided a device and method to maintain the integrity of a vapor barrier for use with concrete slab on grade construction.

In a particular embodiment, the integrity of the vapor barrier is maintained by repairing the vapor after it has been punctured during the slab on grade construction process. In accordance with this embodiment, the apparatus includes a substantially planar concrete slab vapor barrier patch and a resealable aperture, integral to the vapor barrier patch, the aperture adapted to receive a removable support. The resealable aperture may be prefabricated and later connected to the vapor barrier patch, or the vapor barrier patch and the resealable aperture may be fabricated from a contiguous material. Accordingly, a method to repair a punctured concrete slab vapor barrier includes the steps of, puncturing the vapor barrier with a support, positioning a substantially planar vapor barrier patch having a resealable aperture to surround the support, pouring concrete material to cover the vapor barrier patch wherein the support extends above a top surface of the concrete material, removing the support and engaging the resealable aperture to repair the punctured concrete slab vapor barrier.

In a particular embodiment, the bottom side of the vapor barrier patch is coated with an adhesive material. The adhesive material is placed in contact with the existing vapor barrier, thereby providing a more secure placement of the patch during the subsequent concrete pour. Additionally, the bottom of the patch may be coated with an expandable material, such as sodium bentonite. The expandable material may be sensitive to water, such that it expands upon introduction of the concrete, thereby filling the void between the patch and the vapor barrier to establish a substantially fluid tight seal. The expandable material may also possess adhesive qualities. Accordingly, the vapor barrier patch may include expandable material, sealant material, adhesive material or any combination thereof.

A variety of supports are within the scope of the present invention, such as those commonly employed in the construction industry, including, but not limited to, wooden stakes and metal rods of varying sizes and dimensions.

Based on the support selected, the resealable aperture in accordance with the present invention may be adjusted to accommodate the specifics of the support. In an exemplary embodiment, the support stake is a wooden stake having a substantially rectangular cross-section. As such, the resealable aperture may consist of a plurality of flapped openings to receive the support. The flaps may be triangular in shape or rectangular in shape depending upon the dimensions of the support. The flaps may also be designed to overlap each other so as to form an improved seal. As such, a variety of aperture configurations are within the scope of the present invention, with the goal to provide a tight fit between the support and the aperture that will prevent concrete from getting under the vapor barrier and then when the support is removed, to form a substantially fluid tight seal.

To further improve the ability of the invention to protect the concrete slab from excess moisture, the apparatus may further include a substantially cylindrical waterstop adhered to a top side of the vapor barrier patch and positioned to surround the resealable aperture. The waterstop and the patch may be formed separately and then integrated, or they may be formed of a continuous material. The cylindrical waterstop will prevent any moisture that does reach the top of the vapor barrier from traveling across the surface between the slab and the vapor barrier. The moisture is essentially held captive within the walls of the waterstop. The waterstop may additionally have ribbed sidewalls that will further limit the capillary action of moisture that enters the cylinder.

In an additional embodiment, the cylindrical waterstop further includes a lid positioned to cover the top of the cylindrical waterstop to form a waterstop chamber, the lid further includes a lid resealable aperture to receive the support. With this embodiment, the support passes through both the aperture in the vapor barrier patch and the aperture in the lid. As such, after the support is removed, both resealable apertures may close and form a substantially fluid tight seal, or the lid resealable aperture may be designed to allow moisture to enter the chamber to activate an expandable material therein. Any moisture that does enter through the vapor barrier patch aperture is then contained within the waterstop chamber. The flaps of the apertures may be overlapped to further enhance the sealing capability of the chamber. Additionally, the chamber may contain an expandable material. The material may be activated by the addition of water through an external port, from excess water in the concrete, or from the intrusion of moisture from the subgrade. The expandable material may also be injected into the chamber through the external port. Additionally, the expandable material may be contained in a protective pouch within the chamber, and released to expand by pulling a drawstring, or the like, extending above the surface of the concrete.

In additional embodiments, a ring of expandable material may be adhered to the top side of the vapor barrier patch to surround the aperture or a resilient material may be used to form the aperture itself. This resilient material aperture includes an opening to receive the support and upon removal of the support the opening will retract to form a substantially fluid tight seal. In a particular embodiment, the resilient material aperture may be a foam doughnut having an opening to receive the support. The foam doughnut may be fabricated of expandable material or self sealing material and may further include substantially rigid sidewalls.

In yet another embodiment, the resealable aperture is a collapsible chamber. The collapsible chamber is adapted to receive the support and then when the support is removed, the weight of the concrete forces the aperture to collapse upon itself, thereby forming a substantially fluid-tight seal. The interior of the collapsible chamber may be coated with an adhesive material, an expandable material, or both, to further enhance the sealing capability. The collapsible chamber may be conical in shape and have a resealable seam or may be comprised of a single piece of material without a seam. The collapsible chamber may further include an elastic means to secure the chamber to the support. Additionally, the collapsible chamber embodiment may include flaps at the vapor barrier level to receive the support and previously described with reference to other embodiments.

The apparatus may further include additional features that allow it to adapt to various weather conditions. Including, a plurality of drainage holes, a weatherguard cap positioned to prevent the pre-activation of the expandable material within the cylinder, and a drip guard positioned at the apex of the conical collapsible chamber to prevent the pre-activation of the expandable material within the cylinder.

In an additional embodiment, the apparatus in accordance with the present invention may include a support having two portions. The lower support portion extends below the vapor barrier and is not removable. The upper support portion connects to the lower support portion and is then removed after the concrete is poured and sufficiently set. With this embodiment, puncturing the vapor barrier does not result in a hole to be repaired because the lower support portion remains in the subsoil and forms the seal. The connection between the upper support and the lower support may be made many ways, such as threadably or through an interference fit wherein the lower support provides a sleeve to receive the upper support, or other connectivity means known in the art. Additionally, the connection may allow the adjustment of the angle of the upper support thereby providing an angled support for use with the interior form boards.

In yet another embodiment, the vapor barrier is not punctured, but instead the integrity of the vapor barrier is maintained by providing a non-penetrating support member positioned on the top surface of the vapor barrier. The non-penetrating support member includes a vapor barrier patch and is adapted to receive the removable support. The dimensions of the vapor barrier patch are such that the weight of the consolidated concrete placed over the lower support creates a substantially strong resistance to the resulting lateral pressure of the concrete against the support and form boards. Additionally, the vapor barrier patch may further include adhesive features to enhance the contact with the vapor barrier. To provide additional security for the support, the non-penetrating support member may further include securing eyelets. The eyelets may be used to tie-up to permanent structure, such as secured rebar. With this embodiment, the non-penetrating support member may further include flexible or hinging means to allow the adjustment of the support to a variety of angles relative to the surface of the vapor barrier.

The present invention provides an apparatus and method to maintain the integrity of a concrete vapor barrier when utilizing form board support stakes for slab on grade construction.

The prior art does not provide a means for repairing a punctured vapor barrier after the concrete slab has been poured. In the prior art methods, the holes in the vapor barrier remain after the stakes are removed and as such, the slab is exposed to excess moisture through the subgrade. Additionally, the prior art does not provide a means to protect the vapor barrier from being punctured when using form boards that require removable stake supports.

The longstanding but heretofore unfulfilled need for an apparatus and method to maintain the integrity of a concrete vapor barrier having characteristics superior to other solutions known in the art is now met by a new, useful, and nonobvious invention.

BRIEF DESCRIPTION OF THE DRAWINGS

For a fuller understanding of the invention, reference should be made to the following detailed description, taken in connection with the accompanying drawings, in which:

FIG. 2(A)-1(D) is an illustrative view of the device and method of use in accordance with the present invention further including a cylindrical waterstop;

FIG. 8(A)-8(C) are illustrative views of alternative embodiments of the device in accordance with the present invention in which a lower support portion of the stake is not removed prior to resealing the vapor barrier.

FIG. 9(A)-9(D) are illustrative view of alternative embodiments of the device in accordance with the present invention wherein the support maintains the integrity of the vapor barrier without puncturing the barrier.

DETAILED DESCRIPTION OF THE PREFERRED EMBODIMENT

Figure 1A:
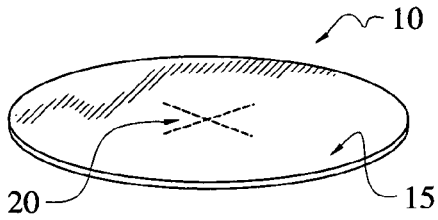
FIG. 1(A)-1(D) is an illustrative view of the device and method of use in accordance with the present invention.
Figure 1B:
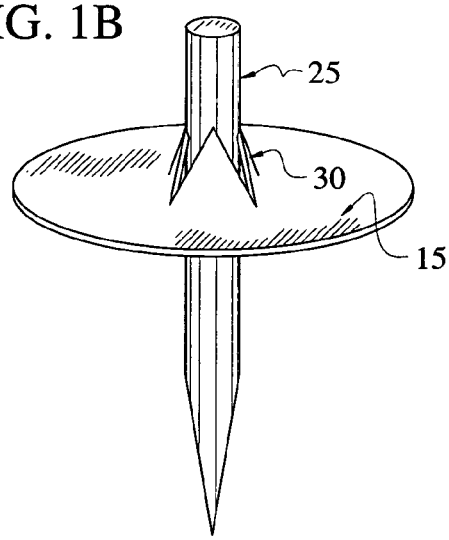
Figure 1C:
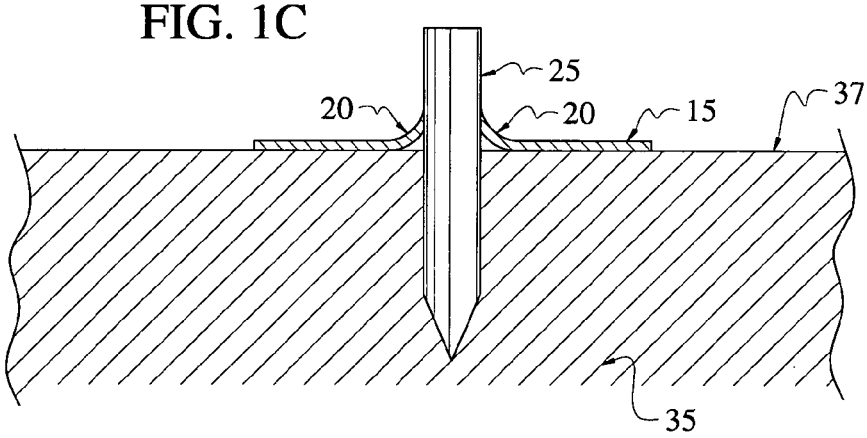
Figure 1D:
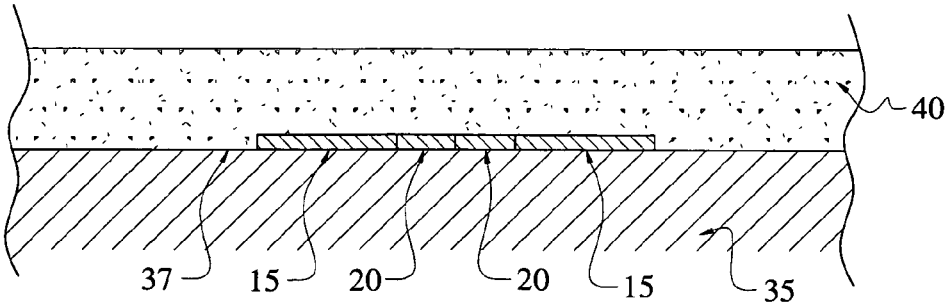

With reference to FIG. 1, a device 10 to maintain the integrity of a vapor barrier in accordance with an embodiment of the present invention is illustrated. The device includes a substantially planar vapor barrier patch 15 having a resealable aperture 20 for receiving a removable support 25. The device is shown in FIG. 1(A) in a condition prior to engagement of the support element 25. The device is shown in FIG. 1(B) in a condition after engagement of the support element 25. In this particular embodiment, the aperture 20 is comprised of four flaps 30 established by making an x-shaped incision in the center area of the vapor barrier patch. FIG. 1(C) illustrates the device as employed in the slab on grade construction process. As shown, the subgrade 35 is covered by a vapor barrier 37. After the vapor barrier 37 is in position, the stakes 25 are driven through the vapor barrier 37 and into the subgrade 35. The device 10 in accordance with the present is then positioned over the stake 25 such that the bottom side of the vapor barrier patch 15 is in contact with the top side of the vapor barrier 37. Referring to FIG. 1(D), after the concrete 40 is poured and has reached an initial set, the stake is removed. Due to the weight and consistency of the concrete, the concrete fills in the gap left by the removed stake and forces the flaps 20 of the device 10 to back to their original position, thereby repairing the vapor barrier puncture under the concrete slab 40.

While FIG. 1 illustrates an aperture 20 comprising four flaps 30 established as in an x-shaped incision, numerous configurations for the aperture are within the scope of the present invention. In an exemplary embodiment, the aperture is adapted to receive a wooden stake. A wood stake typically employed in the concrete industry is a 1'×2" rectangular stake. An aperture adapted to receive such a stake, may consist of flaps that are substantially rectangular. In an additional embodiment, the aperture may be adapted to receive a round steel stake or a flat steel stake. The aperture designed to receive a round steel stake may include a plurality of flaps such that the aperture provides a seal around the perimeter of the stake to prevent the concrete from seeping under the vapor barrier during the pouring step of the process. Additionally, the flaps may be designed to overlap each other to form a tighter fit around the perimeter of the support element. Accordingly, with these embodiments, the aperture is dimensioned to accommodate the support element, while serving to prevent the poured concrete from penetrating below the surface of the vapor barrier. As such, a plurality of configurations for the aperture, designed to accommodate a plurality of support elements, are within the scope of the present invention. As such, when the support is removed, as shown in FIG. 1D, the flaps of the aperture close to form a substantially fluid-tight seal, thereby maintaining the integrity of the concrete vapor barrier.

Referring to FIG. 2, an embodiment of the invention is shown having additional means for reducing moisture in the slab. As shown in FIG. 2(A), an adhesive backing 45 may be applied to a bottom side of the vapor barrier patch 15 to assist in the placement of the patch and to provide a substantially watertight seal between the vapor barrier 37 and the vapor barrier patch 15 to reduce lateral seeping of moisture between the layers. Additionally, the adhesive backing 45 may be an expandable material or an expandable sealant that is expandable upon contact with the moisture present in the concrete mixture. The expandable sealant may additionally include chemical or physical attributes that allow the sealant to expand under certain conditions. In an exemplary embodiment, the expandable sealant would be sensitive to the pH level present in concrete and would expand upon contact with the fluid having a predetermined pH level. With this embodiment, the sealant would not be inadvertently activated by rainwater or other water applied to the concrete surface during the construction process. Many adhesives and expandable sealants are known in the art that would satisfy the requirements of adhering and sealing the vapor barrier patch to the existing vapor barrier. Accordingly, adhesives, expandable materials, and expandable materials having sealing capabilities are all within the scope of the present invention.

Figure 2A:
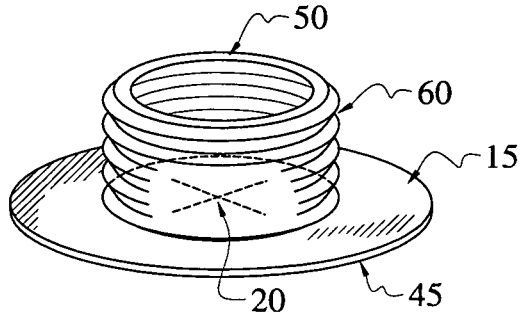
Figure 2B:
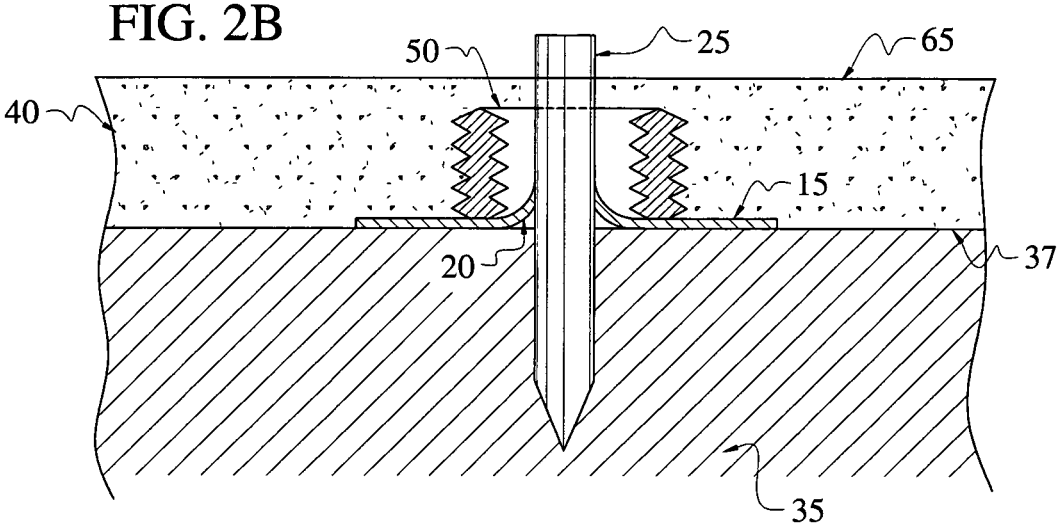
Figure 2C:
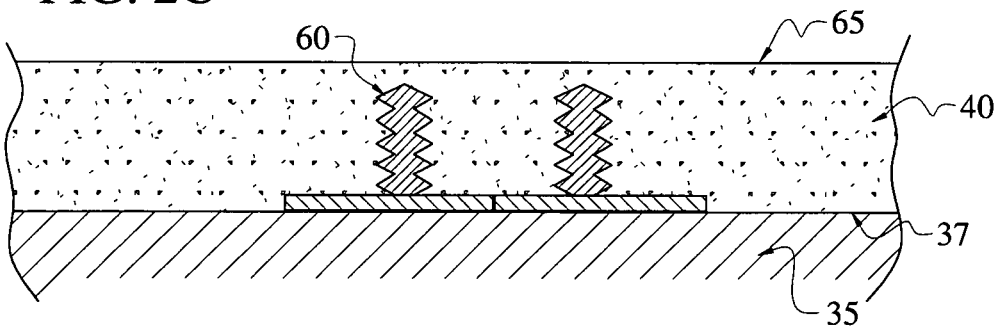

In another embodiment in accordance with the present invention, a substantially cylindrical waterstop 50 is positioned on a top side of the vapor barrier patch 15 to surround the aperture 20, as illustrated in FIG. 2(A). The waterstop 50 serves to capture any moisture that does escape through the aperture 20 and further restricts the moisture within the confines of the cylindrical area, thereby reducing the lateral movement of moisture across the top surface of the vapor barrier. Additionally, the waterstop cylinder 50 may further include ribbed sidewalls 60. The ribbed sidewalls increase the interior surface area of the cylinder 50, thereby reducing the flow rate of moisture up the interior sidewalls of the cylinder 50 due to capillary action. As illustrated with reference to FIG. 2(B), the vapor barrier patch 15 is positioned such that the stake 25 is positioned substantially through the center of the cylindrical waterstop 50 and engages the resealable aperture 20. After the concrete 40 is poured and substantially set, the stake 25 is removed and the malleable concrete flows to fill the interior of the cylindrical waterstop 50, the pressure of the concrete 40 thereby causing the aperture 20 to return to it's unengaged position and reseal the puncture hole in the vapor barrier caused by insertion of the stake 25, as shown in FIG. 2(C).

Figure 2D:
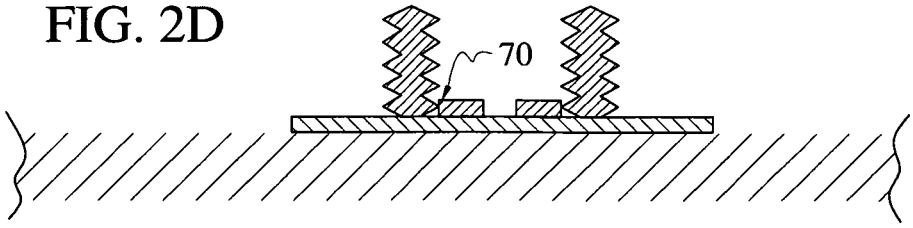

As illustrated in FIG. 2(D), the interior of the cylindrical waterstop 50 may further contain a moisture sensitive expandable material 70. The expandable material would expand to fill the cylinder after the stake is removed and the expandable material comes in contact with the moisture present in the concrete mixture. Additionally, the cylindrical waterstop may be formed of expandable material only, wherein the expandable material forms the sidewalls. This configuration may be accomplished by placing a ring of expandable material around the aperture and allowing the expandable material to expand and form a cylinder upon the addition of water or other activating fluid. In an exemplary embodiment, sodium bentonite is the expandable material, however this is not meant to be limiting, and other expandable materials known in the art are within the scope of the present invention.

Figure 3A:
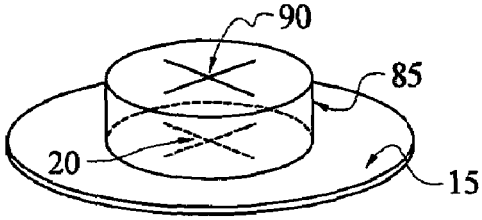
FIG. 3(A)-3(D) are illustrative views of alternate embodiments of the device in accordance with the present invention further including a lid to form a waterstop chamber.
Figure 3B:
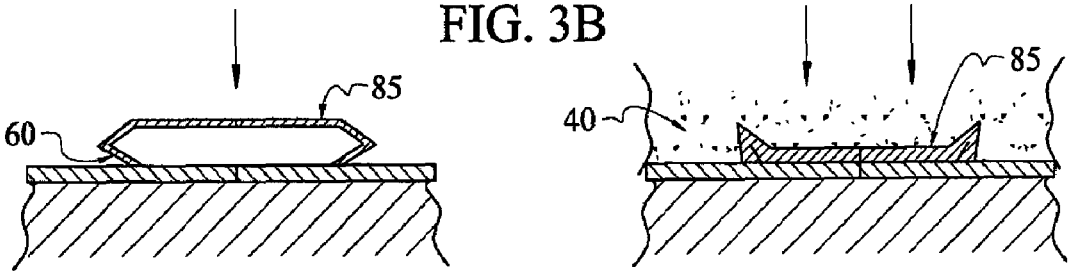

In an additional embodiment, the cylindrical waterstop 50 further includes a lid 85 positioned to cover a top end of the cylinder, thereby forming a waterstop chamber as shown in FIG. 3(A). The lid 85 further includes a resealable aperture 90 to accept the stake 25 or other support. The waterstop chamber 50 may further include expandable material as previously described. In an exemplary embodiment, the sidewalls 60 of the cylindrical waterstop 50 are flexible such that the waterstop chamber essentially collapses upon itself under the pressure of the concrete pour 40. With this embodiment, the lid 85 of the waterstop chamber is pushed down by the weight of the concrete 40 to contact the resealable aperture 20 of the vapor barrier patch 15. As shown with reference to the top down view of FIG. 3(D), the resealable aperture 20 and the resealable aperture of the lid 90 are both formed by an x-shaped incision. Alternatively, the x-shaped incision of the resealable aperture 20 and the lid resealable aperture 90 are rotated relative to one another such that the flaps formed by the x-shaped incisions are not coincident with each other, but rather overlap as shown in the figure, the solid lines of the x-shape identifying the incisions in the resealable aperture 20 and the dashed lines of the x-shape identifying the incisions in the lid resealable aperture 90. This overlap further increases the effectiveness of the device in resealing the punctured vapor barrier. As described elsewhere, the aperture opening is not limited to an "x-configuration".

Figure 3C:
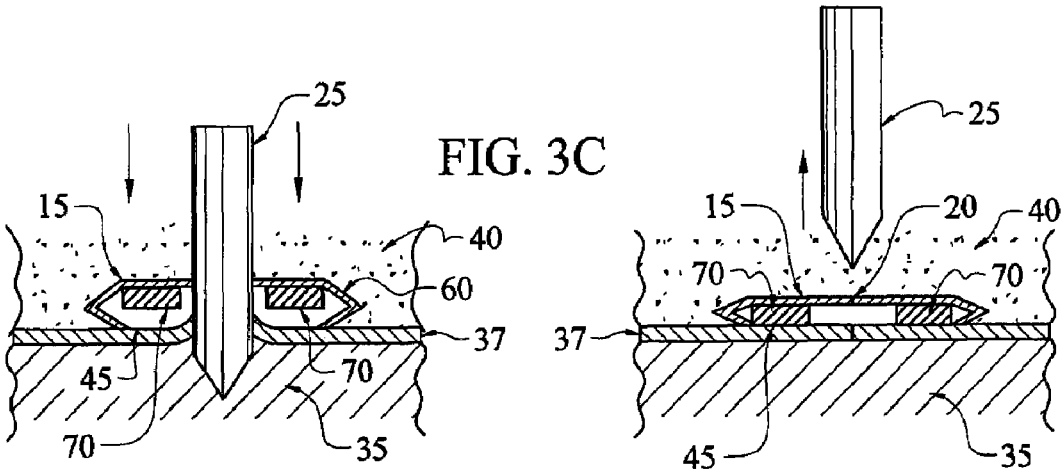
Figure 3D:
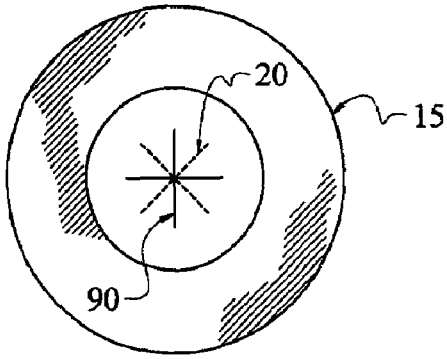

In yet another embodiment, as shown in FIG. 3(C), the waterstop chamber includes expandable sealant material 70 positioned within the interior of the chamber. When the stake 25 is removed from the chamber, the chamber collapses upon itself under the weight of the concrete 40 and the expandable sealant fills any remaining void between the top lid of the chamber and the resealable aperture thereby resealing the punctured vapor barrier.

Figure 4A:
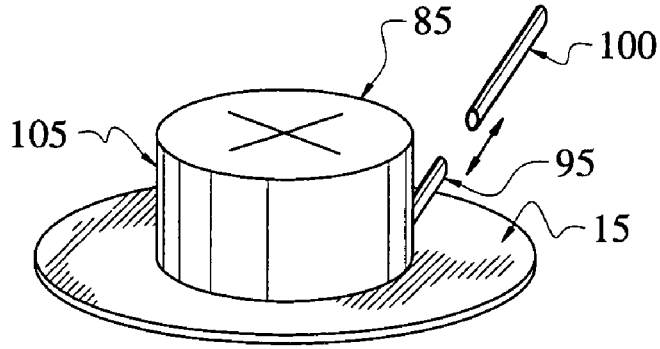
FIG. 4(A)-4(B) are illustrative views of alternate embodiments of the device and method of use in accordance with the present invention further including external means for employing an expandable sealant.
Figure 4B:
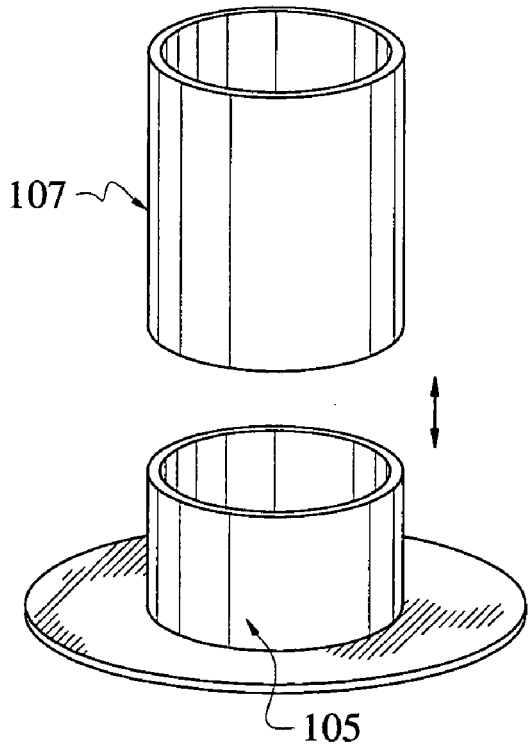

In an additional embodiment, the waterstop chamber may be filled with expandable sealant material 70 after the removal of the stake 25. As shown with reference to FIG. 4(A), an external port 100 is provided and fluidly connected to an inlet 95 to the interior of the waterstop chamber 105. The external port 100 extends above the top surface of the poured concrete. After removal of the stake, the expandable material is inserted into the interior of the waterstop chamber 105 through the external port 100. The external port may then be removed. Referring to FIG. 4(B), the expandable sealant material 70 may also be added to the chamber 95 after the removal of the stake through the use of an extension tube 105. In accordance with this embodiment, a detachable extension tube 105 is positioned to surround the chamber 95 and to extend above the top surface of the poured concrete. After the stake is removed, the expandable material is added to the chamber utilizing the extension tube 105 and then the tube is removed. It is within the scope of the present invention for the extension tube 105 to be rigid or flexible and to be fabricated from a variety of materials commonly known in the art.

Figure 5A:
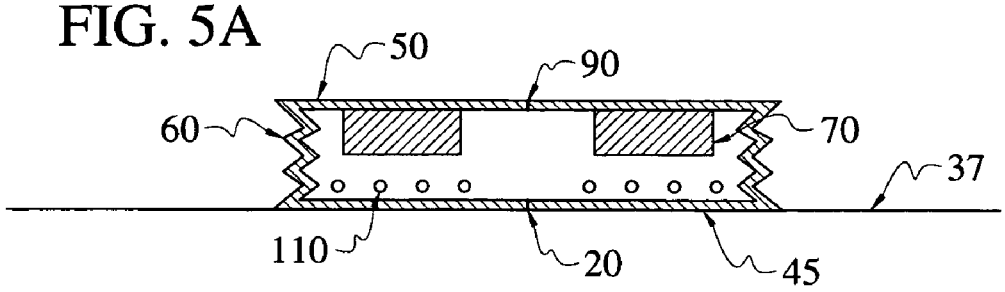
FIG. 5(A)-5(C) are illustrative views of an embodiment of the device in accordance with the present invention further including drainage means.
Figure 5B:
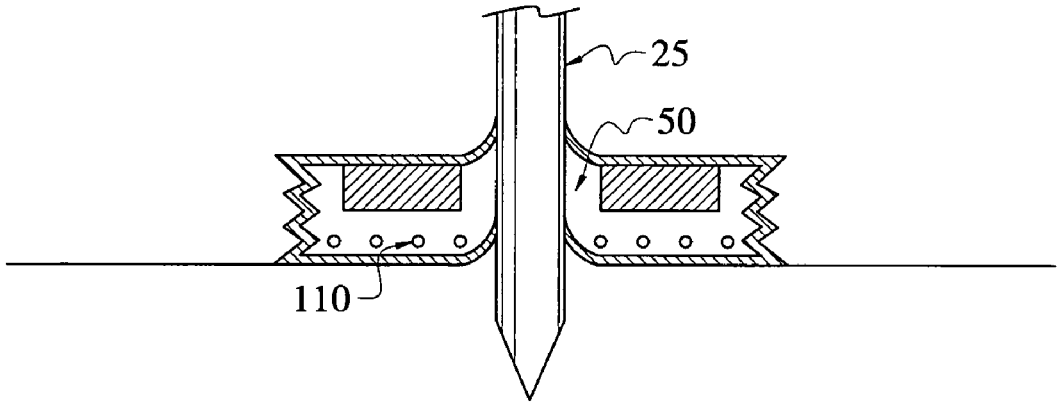
Figure 5C:
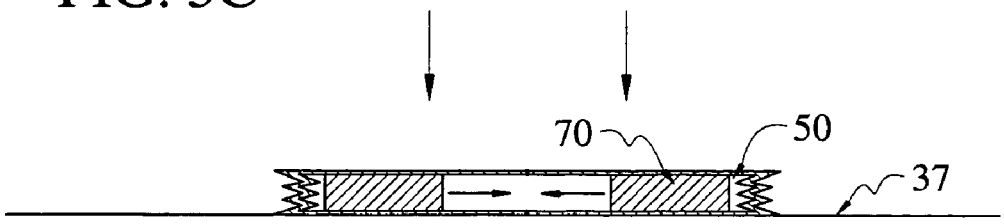

The waterstop chamber exemplified with reference to FIG. 3 may additionally include drainage means to allow rain water to drain out of the chamber and additionally to allow concrete bleed water to enter the chamber and initiate the reaction of the expandable sealer. With reference to FIG. 5(A)-FIG. 5(C), the sidewalls 60 of the waterstop chamber may include drainage holes 110. The drainage holes 110 are positioned at the bottom of the cylinder to allow rain water to drain out and also to allow concrete bleed water to enter for the expanding chemical relation to occur with the expandable sealer 70. After the stake 25 is removed, the pressure of the concrete presses down on the lid of the waterstop cylinder chamber and the sealer 70 is forced to fill the void, thereby forming a seal with the vapor barrier 37.

Figure 6A:
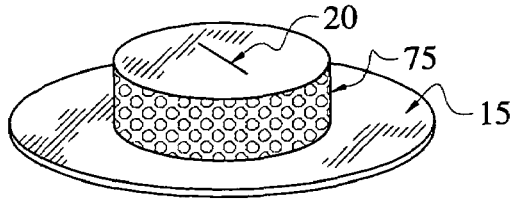
FIG. 6(A)-6(C) are illustrative views of alternative embodiments of the device in accordance with the present invention including additional means for providing a resealable aperture.
Figure 6B:
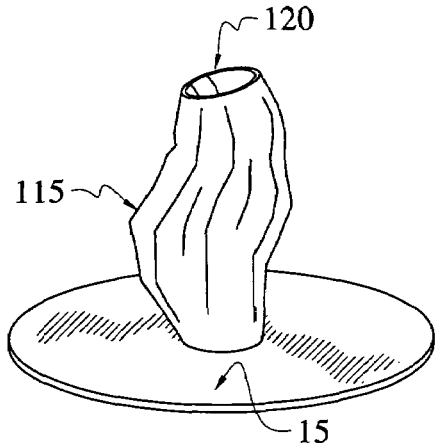
Figure 6C:
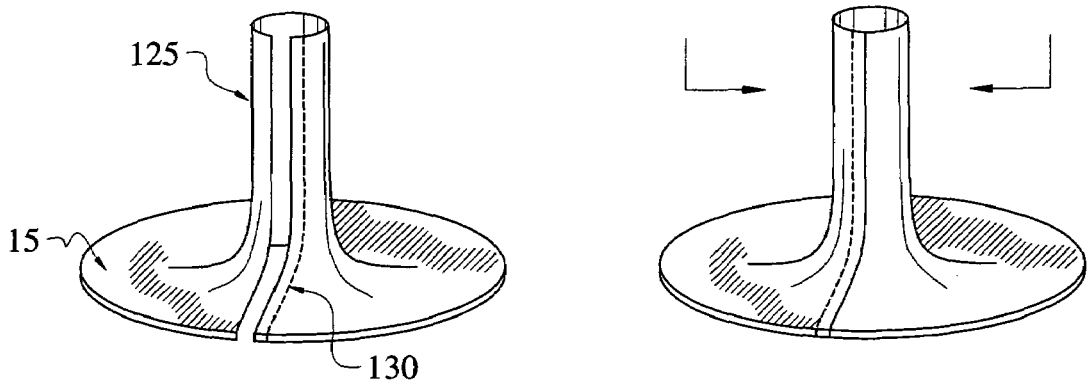

FIG. 6(A)-FIG. 6(C) illustrates additional embodiments in accordance with the present invention. As shown in FIG. 6(A), the cylindrical waterstop may be replaced with a foam donut 75 having an aperture 20 to receive the stake. The foam material comprising the donut could additionally possess sealing and swelling qualities as previously described. As shown in FIG. 6(B), the cylindrical waterstop may be replaced by a collapsible bag 115 having an elastic opening 120 to receive the stake. Upon removal of the stake, the collapsible bag 115 will collapse under the pressure of the concrete, thereby forming a seal with the vapor barrier. The collapsible bag 115 may additionally include adhesive or expandable materials within the interior of the bag as previously described. As illustrated in FIG. 6(C), the cylindrical waterstop may be replaced by a substantially conical enclosure 125 integral to the vapor barrier patch 15. In accordance with this embodiment, the conical enclosure 125 is wrapped around the stake and secured in place by an adhesive seam 130. Upon removal of the stake, the weight of the concrete collapses the conical enclosure upon itself, forming a seal. In an additional embodiment, the apparatus described in FIG. 6 could be adapted for use with non-removable elements that are placed in the concrete and through the vapor barrier, including plumbing, fire and electrical risers. While these elements are not commonly removed, they may still cause damage to the vapor barrier that could result in excess moisture reaching the concrete slab. Waterproof tape, commonly known in the art, may be positioned around the aperture of the conical enclosure, thereby creating a waterstop to prevent moisture that may escape from the subgrade through the puncture hole from reaching the concrete slab.

Figure 7A:
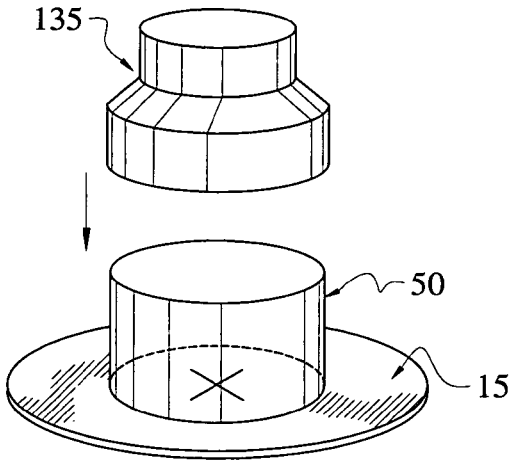
FIG. 7(A)-7(C) are illustrative views of weatherguard protection devices for use with the device in accordance with the present invention.
Figure 7B:
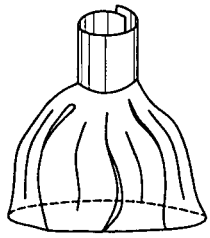
Figure 7C:
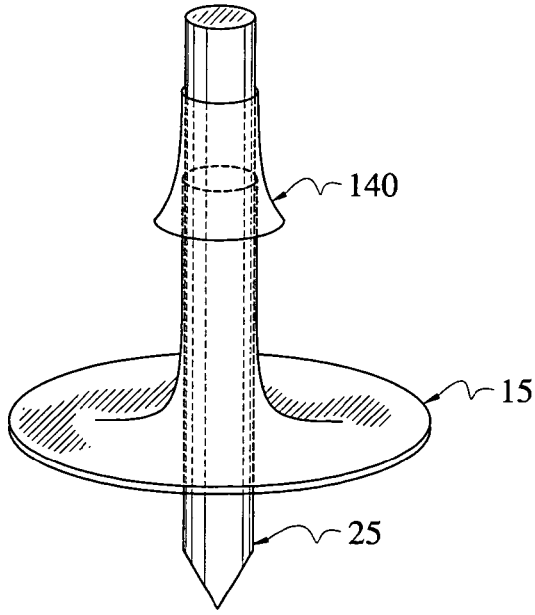

With the use of expandable sealant materials, the need may arise to prevent the expansion of the materials until a predetermined time. As an example, if the expandable sealant material being used is know to expand upon contact with rainwater, it may be necessary to protect the expandable sealant material from rain until the concrete has been poured and the stake removed so as not to expand the sealant prematurely. As such, the present invention provides for weatherguards to protect the expandable sealant from premature expansion. Exemplary embodiments of these weatherguards are shown with reference to FIG. 7(A)-FIG. 7(C). In FIG. 7(A), a stake cap 135 is provided that is dimensioned to cover the stake and a top portion of the cylindrical waterstop 50, thereby preventing moisture, such as rain, from pre-activating the expanding material within the waterstop prior to the concrete pour and subsequent removal of the stake. As shown with reference to FIG. 7(B), protection from rain may also be provided by securing a polyethelyne material to surround the stake and cover the top of the cylinder. Additionally, FIG. 7(C) illustrates the use of a drip guard 140 for use with the conical shaped aperture previously described. The drip guard is designed to prevent moisture from entering the aperture prior to the concrete pour and removal of the stake.

Referring now to FIG. 8(A)-FIG. 8(C), it is within the scope of the present invention to provide a vapor barrier repair device wherein a portion of the support remains permanently in the subsoil. With reference to FIG. 8(A), the device includes a vapor barrier patch 15 having a lower support portion 145 extending below the bottom of the patch and an upper support portion 150 extending above the top of the patch. In a particular embodiment, the lower support portion 145 is driven into the subsoil until the bottom surface of the vapor barrier patch comes in contact with the existing vapor barrier. The upper support portion 150 further includes means for receiving a support stake 155 that will then extend above the surface of the concrete. In an exemplary embodiment, the support stake 155 is screwed to the upper support portion 150, the concrete is poured and then the support stake 155 is unscrewed from the upper support portion 150. The concrete then flows to fill the void left by the support stake 155, leaving the upper support portion 150, the lower support portion 145 and the vapor barrier patch 15 in place. The lower support portion 145 may additionally be of various lengths as necessary to accommodate the support. As shown in FIG. 8(B), the upper support portion 150, may further include a hinging means 160 to allow for the adjustment of the support stake 155 to a variety of angles. The hinging means 160 may additionally be a flexible seal that is removable and can be repositioned as necessary. The support stake may then be secured into a predetermined position utilizing a locking means. In another embodiment illustrated in FIG. 8(C), the upper support portion 150 and the lower support portion 145 form a sleeve to receive the stake. A flexible seal 165 is positioned at the interface of the upper support portion 150 with the vapor barrier patch 15 to allow for the adjustment of the angle of the stake. Additionally, the vapor barrier patch may further include adhesive capability to enhance the contact with the vapor barrier.

Referring now to FIG. 9(A)-9(D), in an embodiment designed to protect the vapor barrier from being punctured by the support stakes during the slab on grade construction process is provided. In this particular embodiment, the resealable aperture further comprises a non-penetrating support member 170 positioned on the top surface of the vapor barrier patch 15, the non-penetrating support member to receive the removable support 25. With this embodiment, the vapor barrier patch 15 is positioned on the top of the vapor barrier patch and may be additionally secured with an adhesive or expandable material. This patch may be constructed of a rigid material and can be integrally constructed with the non-penetrating support. Instead of puncturing the vapor barrier with the stake and then having the aperture to reseal the puncture, with this embodiment, the vapor barrier is not punctured. After the patch is in place, the support in inserted into the non-penetrating support member 170, such as through the use of threads 180. After the concrete is poured, the support 25 is disengaged from the non-penetrating support member 170 thereby maintaining the integrity of the vapor barrier. The non-penetrating support member 170 may additionally include securing eyelets 190. The eyelets can be used to further secure the patch by wiring the eyelets 190 to a permanent support, such as existing rebar. Additionally, to accommodate the need to position support stakes at various angles, the non-penetrating support member 170 may further include a flexible member 185 that will allow the adjustment of the removable support 25 to a variety of angles. The non-penetrating support member may also include means to accommodate a wooden stake as shown with reference to FIG. 9B in which nail holes 175 are positioned within the stake support to allow a wooden stake to be connected.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. An apparatus to repair a puncture in a concrete slab vapor barrier that is below a poured concrete slab, the apparatus comprising:

a substantially planar concrete slab vapor barrier patch having a resealable aperture on a bottom side of the vapor barrier patch, the bottom side positioned to contact the concrete slab vapor barrier and the resealable aperture to surround a removable support that has punctured the concrete slab vapor barrier; and a collapsible chamber positioned on a top side of the vapor barrier patch, the collapsible chamber having a resealable aperture to receive the removable support and flexible sidewalls, the flexible sidewalls of which are of sufficient rigidity to substantially maintain the shape of the chamber upon receipt of the removable support and the flexible sidewalls lacking sufficient rigidity to support the weight of the poured concrete slab, such that the collapsible chamber collapses under the weight of the poured concrete slab and upon removal of the removable support from the concrete slab vapor barrier and the poured concrete slab, the resealable aperture on the bottom side of the vapor barrier patch and the resealable aperture of the collapsible chamber close, thus repairing the puncture in the concrete slab vapor barrier.

2. The apparatus of claim 1, wherein the bottom side of the vapor barrier patch is coated with an adhesive material.

3. The apparatus of claim 1, wherein the bottom side of the vapor barrier patch is coated with an expandable material.

4. The apparatus of claim 3, wherein the expandable material is sodium bentonite.

5. The apparatus of claim 1, wherein the support is a wooden stake.

6. The apparatus of claim 1, wherein the support is a metal rod.

7. The apparatus of claim 1, wherein the resealable aperture of the vapor barrier batch and the resealable aperture of the collapsible chamber further comprises a flapped opening dimensioned to receive the support and to form a substantially fluid tight seal upon removal of the support.

8. The apparatus of claim 1, wherein the resealable aperture of the vapor barrier patch further comprises a plurality of triangular shaped flaps, wherein one side of each of the triangular shaped flaps is integral with the vapor barrier patch.

9. The apparatus of claim 1, wherein the resealable aperture of the collapsible chamber further comprises a plurality of triangular shaped flaps, wherein one side of each of the triangular shaped flaps is integral with the collapsible chamber.

10. The apparatus of claim 1, further comprising an expandable material positioned within the interior of the collapsible chamber, the expandable material being confined to the chamber.

11. The apparatus of claim 1, further comprising a ring of expandable material adhered to a top side of the vapor barrier patch and positioned within the interior of the collapsible chamber, the ring of expandable material to form a substantially fluid tight seal upon removal of the support.

12. The apparatus of claim 1, further comprising an adhesive material positioned with an interior of the collapsible chamber, the adhesive material confined to the interior of the collapsible chamber.

13. The apparatus of claim 1, further comprising an expandable sealant positioned within an interior of the collapsible chamber, the expandable sealant confined to the interior of the collapsible chamber.

* * * * *